US008453687B2

(12) United States Patent
Schmied et al.

(10) Patent No.: US 8,453,687 B2
(45) Date of Patent: Jun. 4, 2013

(54) DEVICE FOR METERING A POWDERED PRODUCT

(75) Inventors: Ralf Schmied, Freiberg (DE); Jens Schlipf, Freiberg (DE); Walter Boehringer, Remshalden (DE)

(73) Assignee: Robert Bosch GmbH, Stuttgart (DE)

( * ) Notice: Subject to any disclaimer, the term of this patent is extended or adjusted under 35 U.S.C. 154(b) by 529 days.

(21) Appl. No.: 12/668,605

(22) PCT Filed: Jul. 1, 2008

(86) PCT No.: PCT/EP2008/058458

§ 371 (c)(1),
(2), (4) Date: Jan. 11, 2010

(87) PCT Pub. No.: WO2009/007275

PCT Pub. Date: Jan. 15, 2009

(65) Prior Publication Data

US 2010/0200112 A1 Aug. 12, 2010

(30) Foreign Application Priority Data

Jul. 9, 2007 (DE) ..... 10 2007 031 856

(51) Int. Cl.
*B65B 43/42* (2006.01)

(52) U.S. Cl.
USPC ..... 141/147; 141/71; 141/144; 141/145; 141/146

(58) Field of Classification Search
USPC ..... 141/71, 144–147, 258
See application file for complete search history.

(56) References Cited

U.S. PATENT DOCUMENTS

| | | | | |
|---|---|---|---|---|
| 3,893,492 | A * | 7/1975 | Nohren | 141/1 |
| 4,062,386 | A * | 12/1977 | Zanasi | 141/258 |
| 4,501,307 | A * | 2/1985 | Moser et al. | 141/258 |
| 5,240,049 | A * | 8/1993 | Chiari | 141/81 |
| 5,626,171 | A * | 5/1997 | Mirri | 141/152 |
| 6,327,835 | B1 * | 12/2001 | Trebbi | 53/53 |
| 6,390,330 | B2 * | 5/2002 | Runft | 222/41 |
| 6,810,930 | B2 * | 11/2004 | Schlipf et al. | 141/258 |
| 7,210,507 | B2 * | 5/2007 | Facchini | 141/146 |
| 7,640,953 | B2 * | 1/2010 | Ansaloni | 141/147 |
| 2001/0035431 | A1 | 11/2001 | Runft | |
| 2004/0172925 | A1 | 9/2004 | Ragazzini et al. | |

FOREIGN PATENT DOCUMENTS

| | | | |
|---|---|---|---|
| DE | 2050885 | | 4/1971 |
| DE | 2807174 | A1 | 8/1978 |
| DE | 10001068 | C1 | 5/2001 |
| DE | 10211118 | A1 | 9/2003 |
| DE | 69905393 | T2 | 10/2003 |
| DE | 102005039765 | A1 | 3/2007 |
| DE | 102006013160 | A1 | 5/2007 |

(Continued)

*Primary Examiner* — Timothy L Maust

(74) *Attorney, Agent, or Firm* — Michael Best & Friedrich LLP

(57) ABSTRACT

A device for metering of powdery filling material is proposed, with a filling material container, on the bottom of which at least one metering opening is arranged, with at least one transfer plunger which can be introduced by a movement system into the metering opening in order to transfer the filling material located in the metering opening into a receptacle. In addition to the movement system, a drive unit is provided for applying a force to the transfer plunger in order to assist the transfer of the filling material into the receptacle.

19 Claims, 3 Drawing Sheets

FOREIGN PATENT DOCUMENTS

| | | | |
|---|---|---|---|
| DE | 102006014496 | A1 | 10/2007 |
| DE | 102006031250 | A1 | 1/2008 |
| JP | 57199533 | A | 12/1982 |
| WO | 2004004627 | A1 | 1/2004 |

* cited by examiner

DEVICE FOR METERING A POWDERED PRODUCT

CROSS-REFERENCE TO RELATED APPLICATION

This application is a 35 USC 371 application of PCT/EP2008/058458 filed on Jul. 1, 2008.

BACKGROUND OF THE INVENTION

1. Field of the Invention

The invention is based on a device for metering a powdered product.

2. Description of the Prior Art

From German Patent Disclosure DE 102 11 118 A1, one such device is already known, which has a product container with bores embodied in its bottom. The bores cooperate with stuffing plungers and transfer plungers. A stuffing ring that serves as a counterholder to the stuffing plungers is disposed below the bottom. To avoid powder losses, it is provided that the product container is embodied axially movably, in such a way that during the downward motion of the stuffing plungers, the product container can be pressed against the stuffing ring. This is accomplished by means of holding-down elements that are movable synchronously with the stuffing plungers.

Particularly in transferring powder from sticky products, the powder compact can stick to the transfer plunger and thus not drop on its own into the bottom part of a capsule that is standing ready. In a known solution to this problem, the transfer plunger is kept in position, just above the segment of the bottom part, until such time as the capsule transporter carrying the circularly arranged bottom-part segments has moved onward by a certain angle. Since the upper edge of the bottom parts of the capsules is located at a lower level than the upper edge of the segment of the bottom part, the powder compacts become sheared off by the transfer plungers at the upper edge of the segments of the bottom part and then either drop into the bottom parts of the capsules or remain sticking to the edge of the bore in the segment of the bottom part. However, because the powder compacts break off unevenly, the result is imprecisions in dosage and dragging or soiling of the product as well as problems in closing the capsules. It is the object of the invention to overcome the aforementioned disadvantages.

ADVANTAGES AND SUMMARY OF THE INVENTION

The device according to the invention for metering a powdered product has the advantage over the prior art that the powder compacts can be knocked clean securely during the transfer operation. By means of the additional drive unit, such a strong force can be exerted on the transfer plungers that are in contact with the product that because of the spontaneous acceleration of the heavy transfer plungers on the one hand and the mass inertia of the very lightweight powder compacts (or product) on the other, a tearing force is exerted that is greater than the forces of adhesion operative until then between the transfer plunger and the powder compact. The powder compacts thus detached then travel in free fall, unhindered, along their further course downward back into the bottom part of the capsule.

In an expedient refinement, it is provided that the drive unit speeds up the transfer plunger counter to the transfer direction. A vehement impetus or impact can shoot the plunger suddenly upward during the fading downward motion, so that especially strong forces act on the plunger.

BRIEF DESCRIPTION OF THE DRAWINGS

One exemplary embodiment of the device according to the invention for metering a powdered product will be described in further detail below in conjunction with the drawings, in which.

DESCRIPTION OF THE PREFERRED EMBODIMENT

Figure 1:
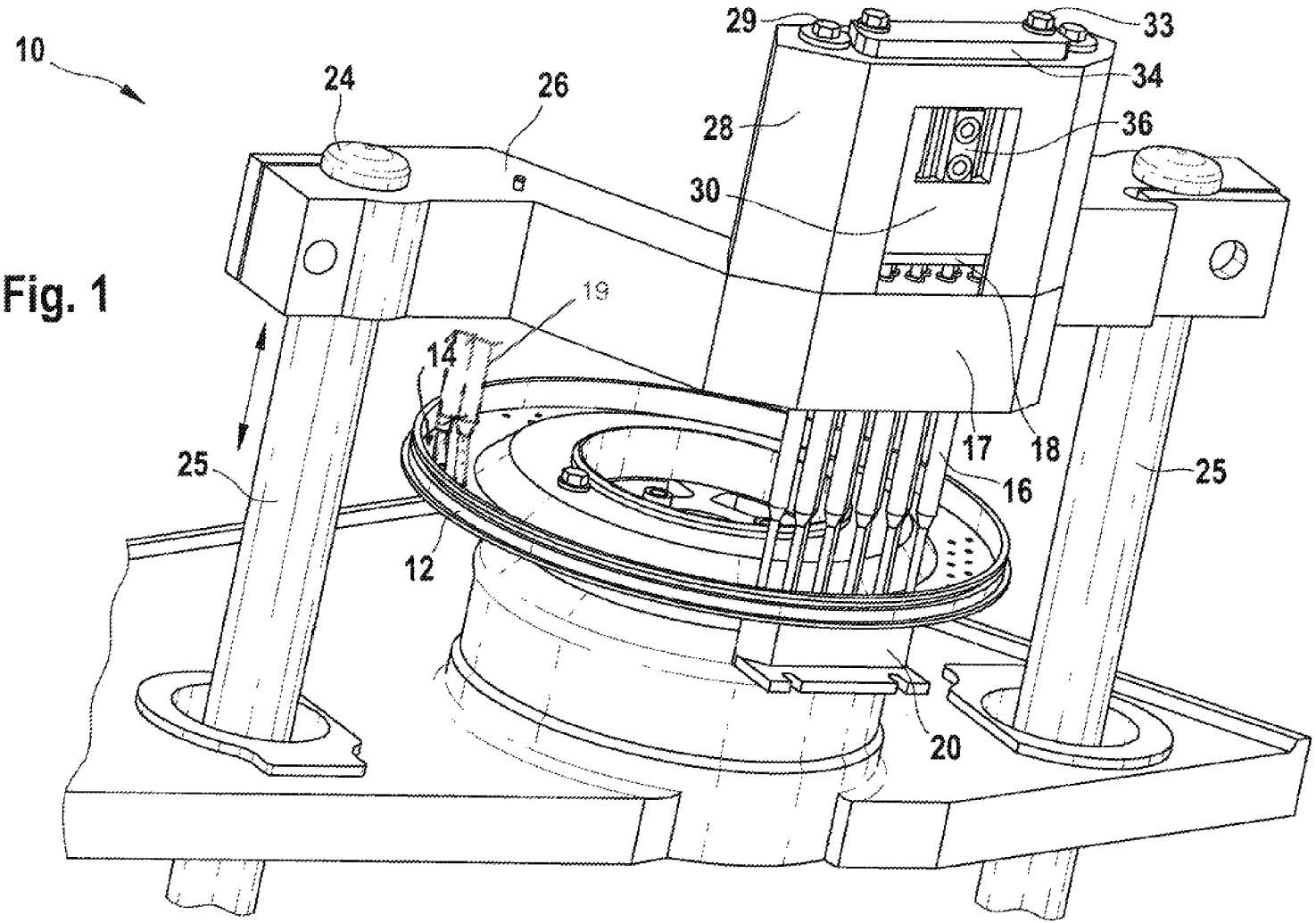
FIG. 1 shows a perspective view of the metering device.
Figure 2:
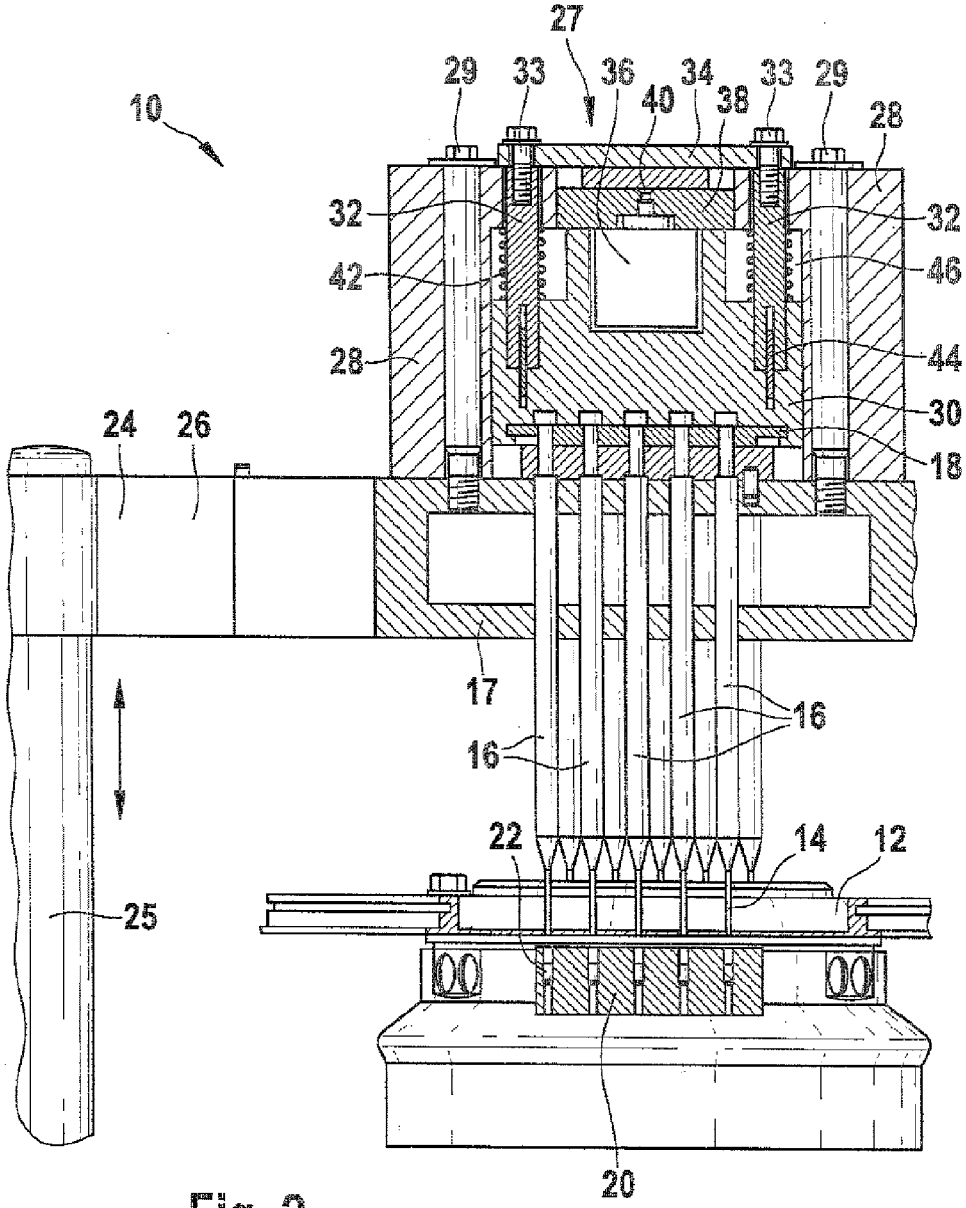
FIG. 2 is a sectional view through the additional drive unit.
Figure 3:
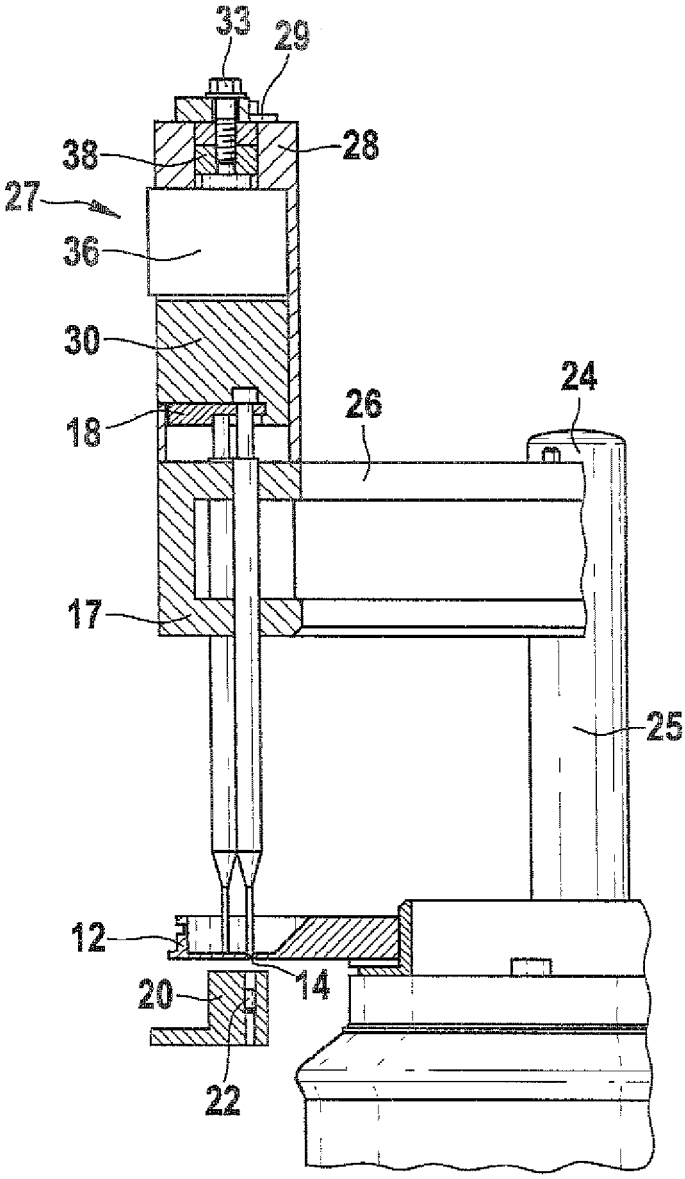
FIG. 3 shows a further sectional view, rotated by 90° relative to FIG. 2.

The device 10 described thus far serves to meter the product into bottom parts 22 of the capsules that stand ready. To that end, the product container 12 is rotated in increments to beneath stuffing plungers 19, or in the transfer position to beneath the transfer plungers 16. During the stopped phase of the product container 12, a product, such as powder or pellets, located in the region of the metering openings 14 is forced into the metering openings 14 by a downward motion of the stuffing plunger 19. In the region of the transfer plungers 16 in which the metering openings 14 communicate with the bottom parts 22 of the capsules located beneath them, the powder compact is thrust by the transfer plunger 16 into the respective bottom part 22 of the capsule by a downward motion of the movement system 24. Particularly with sticky products or from a static charge, powder compacts may still stick to the transfer plungers 16. This is now prevented by the drive unit 27, which is provided in addition to the movement system 24 and which by a knocking-off motion reinforces the dropping of the powder compacts from the transfer plungers 16. At the end of the transfer stroke described, the transfer plungers 16 are slowed down by the braked downward motion. The drive unit 27, for instance comprising the pneumatic cylinder 36 and the lifting tappet 38, now comes into action. By means of the pneumatic cylinder 36, the lifting tappet 38 is accelerated upward, counter to the transfer direction, and with full force strikes the underside of the yoke 34. The yoke 34 is mechanically coupled via the shafts 32 to the connecting pins 44 to the transfer plunger holder 30, so that the transfer plungers 16 jerk forcefully counter to the transfer direction. The transfer plunger holder 30 is connected rigidly to the tops of the transfer plungers 16 via the comb 18. This vehement impetus accelerates the transfer plungers 16 suddenly upward during the fading downward motion. The spontaneous acceleration of the heavy transfer plungers 16 on the one hand and the mass inertia of the very lightweight powder compacts on the other bring about a tearing force that is greater than the forces of adhesion, operative until then, between the transfer plunger 16 and the powder compact. The thus-detached powder blank now traverses the further course downward unhindered, in free fall, into the bottom part 22 of the capsule that is standing ready. The transfer plunger holder 30 moved upward relative to the guide 28 is returned to the original outset position downward in the transfer direction.

In addition to the movement system 24, the transfer plungers 16 can now be moved in the transfer direction relative to the transverse arm 26 by a drive unit 27. One component of the drive unit 27 is a pneumatic cylinder 36, with which via a countersunk screw 40 a lifting tappet 38 is connected. Upon activation of the pneumatic cylinder 36, the lifting tappet 38 presses against the underside of a yoke 34 that completely covers the lifting tappet 38. The yoke 34 is in turn, secured via respective screws 33 laterally to shafts 32 oriented in the transfer direction. The shafts 32 are in turn connected on their respective ends to a transfer plunger holder 30 via connecting pins 44. A comb 18 is disposed in the transfer plunger holder 30 for securing the ends of the transfer plungers 16 to the transfer plunger holder 30. The transfer plunger holder 30, comb 18, shafts 32, yoke 34 and screws 33 form a unit whose parts are fixed relative to one another and which can move in a guide 28 relative to the transverse arm 26, in or counter to the transfer direction. The guide 28 is solidly connected to the transverse arm 26 and its plunger guide 17 via a respective screw means 29.

The shaft 32 penetrates the guide 28 via a suitable opening and protrudes past a recess 46 into the interior of the transfer plunger holder 30 so as to be solidly connected to it via the connecting pin 44. In the region of the recess 46, a spring 42 is disposed around each shaft 32 and is braced on its upper side relative to the guide 28 and on its underside relative to the upper side of the transfer plunger holder 30. The spring 42 serves to return the unit, comprising the transfer plunger holder 30, shafts 32, screws 33, and yoke 34, to the original outset position, counter to the transfer direction, once a stroke has taken place. It can also be seen from FIG. 1 that the transfer plunger holder 30 is guided substantially in cuplike fashion relative to the guide 28. This prevents contamination of the transfer plunger holder 30 by the product.

The device 10 described thus far serves to meter the product into bottom parts 22 of the capsules that stand ready. To that end, the product container 12 is rotated in increments to beneath stuffing plungers, not shown, or in the transfer position to beneath the transfer plungers 16. During the stopped phase of the product container 12, a product, such as powder or pellets, located in the region of the metering openings 14 is forced into the metering openings 14 by a downward motion of the stuffing plunger, not shown. In the region of the transfer plungers 16 in which the metering openings 14 communicate with the bottom parts 22 of the capsules located beneath them, the powder compact is thrust by the transfer plunger 16 into the respective bottom part 22 of the capsule by a downward motion of the movement system 24. Particularly with sticky products or from a static charge, powder compacts may still stick to the transfer plungers 16. This is now prevented by the drive unit 27, which is provided in addition to the movement system 24 and which by a knocking-off motion reinforces the dropping of the powder compacts from the transfer plungers 16. At the end of the transfer stroke described, the transfer plungers 16 are slowed down by the braked downward motion. The drive unit 27, for instance comprising the pneumatic cylinder 36 and the lifting tappet 38, now comes into action. By means of the pneumatic cylinder 36, the lifting tappet 38 is accelerated upward, counter to the transfer direction, and with full force strikes the underside of the yoke 34. The yoke 34 is mechanically coupled via the shafts 32 to the connecting pins 44 to the transfer plunger holder 30, so that the transfer plungers 16 jerk forcefully counter to the transfer direction. The transfer plunger holder 30 is connected rigidly to the tops of the transfer plungers 16 via the comb 18. This vehement impetus accelerates the transfer plungers 16 suddenly upward during the fading downward motion. The spontaneous acceleration of the heavy transfer plungers 16 on the one hand and the mass inertia of the very lightweight powder compacts on the other bring about a tearing force that is greater than the forces of adhesion, operative until then, between the transfer plunger 16 and the powder compact. The thus-detached powder blank now traverses the further course downward unhindered, in free fall, into the bottom part 22 of the capsule that is standing ready. The transfer plunger holder 30 moved upward relative to the guide 28 is returned to the original outset position downward in the transfer direction.

The described device for metering a powdered product is suitable particularly for powder metering devices in the pharmaceutical field. However, it is not limited to that. Modifications with regard to the drive unit 27 are also possible without departing from the concept of the invention. What is essential is that a sufficiently strong force is exerted on the transfer plunger 16 that any product still adhering is acted upon by such a great force that it drops away from the underside of the transfer plunger 16. This can be effected hydraulically, pneumatically or electrically, for instance by means of an electric drive mechanism, or by other suitable drive units.

The foregoing relates to the preferred exemplary embodiment of the invention, it being understood that other variants and embodiments thereof are possible within the spirit and scope of the invention, the latter being defined by the appended claims.

The invention claimed is:

1. A device for metering a powdered product, the device comprising:

a product container on a bottom of which at least one metering opening is disposed;

a stuffing plunger which meters and compacts the powdered product into the at least one metering opening when the container is in a first position;

at least one transfer plunger which can be introduced into the metering opening via a movement system when the container is in a second position, the at least one transfer plunger transferring the product, located in the metering opening, into a receptacle; and a drive unit in addition to the movement system which exerts a force on the transfer plunger so that any of the product still adhering to the transfer plunger after being introduced into the metering opening is separated from the transfer plunger, the drive unit moving the at least one transfer plunger relative to the movement system.

2. The device as defined by claim 1, wherein the drive unit exerts a brief impact on the transfer plunger.

3. The device as defined by claim 1, wherein the drive unit exerts a force counter to a transfer direction on the transfer plunger.

4. The device as defined by claim 2, wherein the drive unit exerts a force counter to a transfer direction on the transfer plunger.

5. The device as defined by claim 1, wherein the drive unit is operated hydraulically, pneumatically, or electrically.

6. The device as defined by claim 2, wherein the drive unit is operated hydraulically, pneumatically, or electrically.

7. The device as defined by claim 1, wherein a transfer plunger holder is provided, which serves to secure the at least one transfer plunger and which is movable in a transfer direction relative to the movement system by the drive unit.

8. The device as defined by claim 2, wherein a transfer plunger holder is provided, which serves to secure the at least one transfer plunger and which is movable in a transfer direction relative to the movement system by the drive unit.

9. The device as defined by claim 3, wherein a transfer plunger holder is provided, which serves to secure the at least one transfer plunger and which is movable in a transfer direction relative to the movement system by the drive unit.

10. The device as defined by claim 7, wherein a guide is provided, in order to enable a relative motion between the movement system and the transfer plunger holder.

11. The device as defined by claim 7, wherein a lifting tappet, actuated by a cylinder, presses against an underside of a yoke for moving the transfer plunger holder and/or the transfer plunger.

12. The device as defined by claim 10, wherein a lifting tappet, actuated by a cylinder presses against an underside of a yoke for moving the transfer plunger holder and/or the transfer plunger.

13. The device as defined by claim 1, wherein the transfer plunger is movable relative to a transverse arm of the drive unit.

14. The device as defined by claim 11, wherein at least one spring is disposed between the guide and the transfer plunger holder.

15. A device for metering a powdered product, the device comprising:

a product container on a bottom of which at least one metering opening is disposed;

at least one transfer plunger which can be introduced into the metering opening via a movement system, the at least one transfer plunger transferring the product, located in the metering opening, into a receptacle; and a drive unit in addition to the movement system which exerts a force on the transfer plunger so that any of the product still adhering to the transfer plunger is separated from the transfer plunger, wherein a transfer plunger holder is provided, which serves to secure the at least one transfer plunger and which is movable in a transfer direction relative to the movement system by the drive unit, wherein a guide is provided, in order to enable a relative motion between the movement system and the transfer plunger holder, and wherein at least one spring is disposed between the guide and the transfer plunger holder.

16. The device as defined by claim 15, wherein a yoke is connected to the transfer plunger holder via at least one shaft.

17. The device as defined by claim 15, wherein the spring is disposed surrounding the shaft.

18. A device for metering a powdered product, the device comprising:

a product container on a bottom of which at least one metering opening is disposed;

at least one transfer plunger which can be introduced into the metering opening via a movement system, the at least one transfer plunger transferring the product, located in the metering opening, into a receptacle; and a drive unit in addition to the movement system which exerts a force on the transfer plunger so that any of the product still adhering to the transfer plunger after being introduced into the metering opening is separated from the transfer plunger, wherein a transfer plunger holder is provided, which serves to secure the at least one transfer plunger and which is movable in a transfer direction relative to the movement system by the drive unit, wherein a lifting tappet, actuated by a cylinder, presses against an underside of a yoke for moving the transfer plunger holder and/or the transfer plunger, and wherein the yoke is connected to the transfer plunger holder via at least one shaft.

19. The device as defined by claim 18, wherein the spring is disposed surrounding the shaft.

* * * * *

UNITED STATES PATENT AND TRADEMARK OFFICE

CERTIFICATE OF CORRECTION

PATENT NO. : 8,453,687 B2
APPLICATION NO. : 12/668605
DATED : June 4, 2013
INVENTOR(S) : Schmied et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 631 days.

Signed and Sealed this
Eighth Day of September, 2015

Michelle K. Lee

Michelle K. Lee
*Director of the United States Patent and Trademark Office*